US007118326B2

(12) United States Patent
Liang

(10) Patent No.: US 7,118,326 B2
(45) Date of Patent: Oct. 10, 2006

(54) COOLED GAS TURBINE VANE

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 125 days.

(21) Appl. No.: 10/871,474

(22) Filed: Jun. 17, 2004

(65) Prior Publication Data

US 2005/0281667 A1 Dec. 22, 2005

(51) Int. Cl.
*F01D 9/02* (2006.01)
*F01D 5/18* (2006.01)

(52) U.S. Cl. ..... 415/115; 416/97 R

(58) Field of Classification Search ..... 415/115; 416/97 R, 96 A
See application file for complete search history.

(56) References Cited

U.S. PATENT DOCUMENTS 3,846,041 A * 11/1974 Albani ..... 416/97 R
4,105,364 A 8/1978 Dodd
4,183,716 A 1/1980 Takahara et al.
4,203,706 A * 5/1980 Hess ..... 416/97 A
4,229,140 A * 10/1980 Scott ..... 416/97 R
4,697,985 A 10/1987 Suzuki
4,930,980 A 6/1990 North et al.
5,328,331 A 7/1994 Bunker et al.
5,383,766 A 1/1995 Przirembel et al.
5,399,065 A 3/1995 Kudo et al.
5,405,242 A 4/1995 Auxier et al.
5,488,825 A 2/1996 Davis et al.
5,609,466 A 3/1997 North et al.
5,645,397 A * 7/1997 Soechting et al. ..... 416/97 R
5,702,232 A 12/1997 Moore
5,772,398 A 6/1998 Noiret et al.
5,820,337 A 10/1998 Jackson et al.
5,964,575 A 10/1999 Marey
5,997,251 A 12/1999 Lee
6,000,908 A 12/1999 Bunker
6,089,822 A 7/2000 Fukuno
6,109,867 A 8/2000 Jacques Portefaix
6,206,638 B1 3/2001 Glynn et al.
6,254,334 B1 7/2001 LaFleur
6,305,903 B1 * 10/2001 Semmler et al. ..... 416/97 R
6,379,118 B1 4/2002 Lutum et al.
6,402,470 B1 6/2002 Kvasnak et al.
6,416,284 B1 7/2002 Demers et al.
6,471,480 B1 10/2002 Balkcum, III et al.
6,499,950 B1 12/2002 Willet et al.
6,508,620 B1 1/2003 Sreekanth et al.
6,533,547 B1 3/2003 Anding et al.
6,554,563 B1 4/2003 Noe et al.
6,582,186 B1 6/2003 Manzoori et al.
2002/0164250 A1 11/2002 Chung et al.
2002/0182056 A1 12/2002 Widrig et al.

* cited by examiner

*Primary Examiner*—Edward K. Look
*Assistant Examiner*—Richard A. Edgar

(57) ABSTRACT

A gas turbine airfoil (e.g. 12) includes a pressure sidewall (14) and a suction sidewall (16) joined along respective leading and trailing edges (18, 20) and extending radially outward from an inner diameter (26) to an outer diameter (22). The airfoil includes a plurality of suction side flow channels (52) extending chordwise within the suction sidewall and having respective heights selected to achieve a desired degree of cooling for the suction sidewall. The airfoil also includes a plurality of pressure side flow channels (30) extending chordwise within the pressure sidewall and having respective heights selected to achieve a desired degree of cooling for the pressure sidewall. A transition region (58) is provided in each flow channel wherein the height of the channel is reduced to an outlet height so that respective outlets of the flow channels can each be independently disposed in the trailing edge.

16 Claims, 3 Drawing Sheets

COOLED GAS TURBINE VANE

FIELD OF THE INVENTION

This invention relates generally to gas turbines engines, and, in particular, to a cooled gas turbine vane.

BACKGROUND OF THE INVENTION

Gas turbine airfoils exposed to hot combustion gases have been cooled by passing a cooling fluid, such as compressed air bled from a compressor of the gas turbine, through a hollow interior of the airfoil to convectively cool the airfoil. Gas turbine airfoils such as vanes may be provided with a cooling fluid to cool the vane but the vane may also be required to conduct a portion of the cooling fluid to cool a downstream element of the turbine. FIG. 1 illustrates a known arrangement for cooling a gas turbine vane 96 and conducting a portion of a cooling fluid downstream. The gas turbine vane 96 depicted in FIG. 1 may include an outer hollow member 98 having a desired airfoil shape exposed to a hot combustion gas 100 and an inner hollow member 102 held spaced inwardly away from the outer hollow member 98 to form a cooling space 104 between the inner and outer members. Typically, the outer hollow member 98 serves as a structural member of the vane 96 and the inner hollow member 102 may be formed as a sleeve for insertion into the outer hollow member 98. The inner hollow member 102 may include a fluid flow path 106 for conducting a cooling fluid flow 108 through the vane 96 to cool a downstream element, such as a turbine blade, using a tangential on-board injection (TOBI) system. In addition, passageways 110 may be formed in the inner hollow member 102 to allow a portion of the cooling fluid flow 108 to exit the fluid flow path into the space 104 between the inner and outer members to cool the outer hollow member 98, such by using the known technique of impingement cooling. The impinged cooling fluid 112 may be allowed to mix in a trailing edge region 114 and then may be directed to exit a trailing edge 116 of the vane 96. In such vane designs, it is important to control the cooling fluid flow through the vane to provide sufficient cooling of the vane, while also providing a cooling fluid flow effective to cool downstream elements, such as a row of blades disposed downstream of the vane 96. One of the problems with such designs is that a distribution and velocity of the cooling fluid flow in the space 104 between the inner and outer members may be difficult to control to achieve a desire cooling effect. Another problem is that a seal (not shown) typically needs to be provided between the inner hollow member 102 and the outer hollow member 98 (such as around the periphery of the inner hollow member 102 near a location where the cooling fluid flow 108 is injected into the vane 96). Such a seal needed to seal the space 104 between the inner hollow member 102 and the outer hollow member 98 to insure that the cooling fluid flow 108 flows within the inner hollow member 102 before being allowed to exit the fluid flow path 106 through the passageways 110 into the space 104. Furthermore, for gas turbine vanes having a complex shape, such as a twisting or bending geometry along a radial axis, it may be difficult to fit the vane with an inner member formed as an insertable sleeve.

BRIEF DESCRIPTION OF THE DRAWINGS

The invention will be more apparent from the following description in view of the drawings that show.

DETAILED DESCRIPTION OF THE INVENTION

Cooled gas turbine airfoils, for example, gas turbine vanes having insertable sleeve cooling designs, may not be able to provide an effective amount of control over cooling of certain regions of the airfoil, such as a suction side and pressure side of the airfoil in a trailing edge region due to mixing of cooling flows in this region. The inventor of the present invention has developed an improved gas turbine airfoil having chordwise cooling channels formed within the walls of the airfoil. Advantageously, the cooled airfoil may be formed using known casting techniques to provide complex airfoil geometries not capable of being cooled using conventional sleeved airfoil designs.

Figure 2:
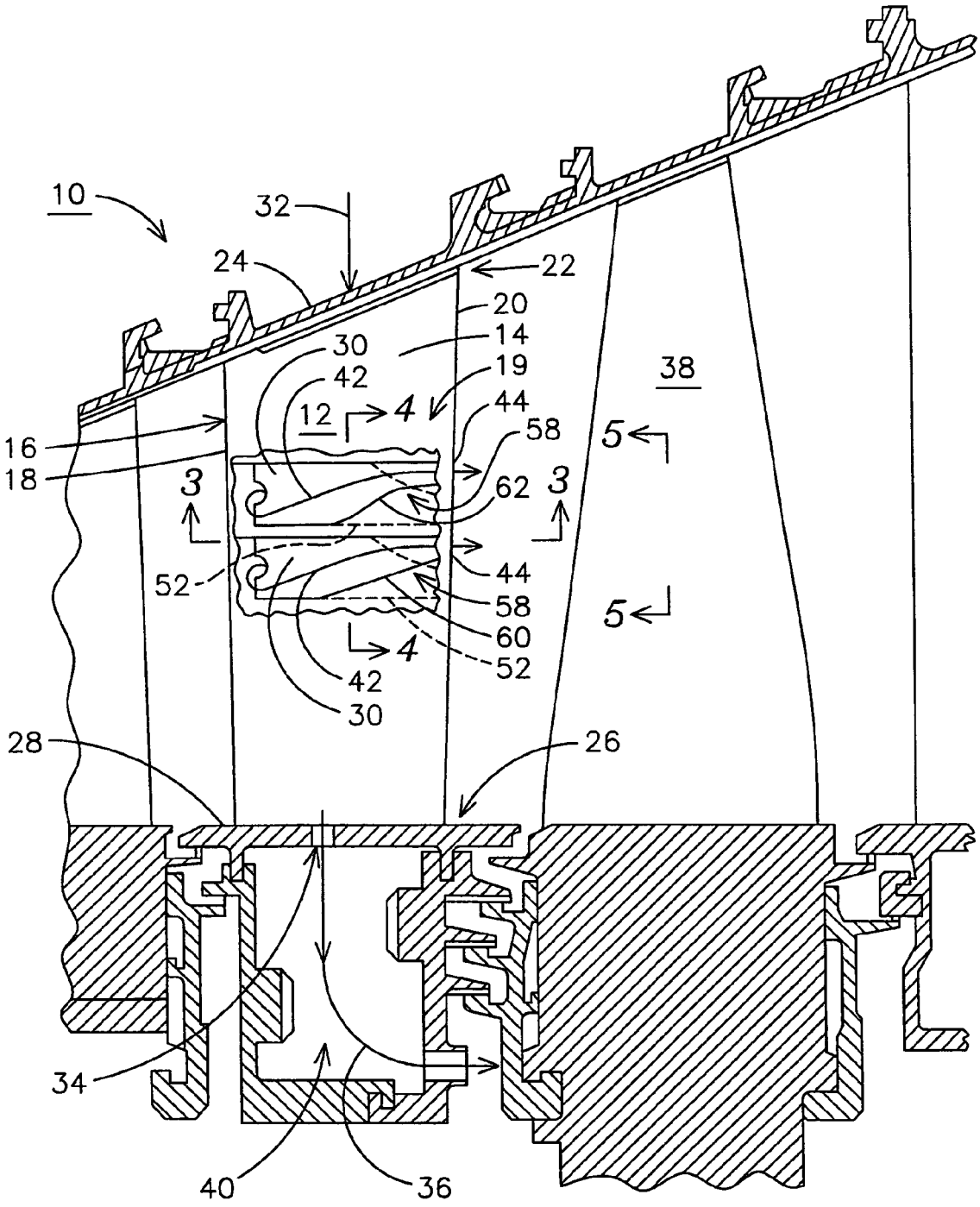
FIG. 2 is a cross sectional view of a portion of gas turbine having an improved cooled vane.

FIG. 2 is a cross sectional view of a portion 10 of gas turbine having an improved cooled vane 12. Generally, the vane 12 includes a pressure sidewall 14 and a suction sidewall 16 joined along a leading edge 18 and a trailing edge 20 and extending radially outward from a outer diameter (O.D.) 22 attached to an O.D. shroud 24 to an inner diameter (I.D.) 26 having an I.D. shroud 28 attached thereto. A cooling fluid flow 32 may be injected into the vane 12 through the O.D. shroud 24, and a passageway 34, such as a metering hole or holes, may be formed in the I.D. shroud 28 to provide a portion 36 of the cooling fluid flow to a downstream element, such as a turbine blade 38 using a TOBI 40. The passageway 34 may be sized and configured to control the portion 36 of the cooling fluid flow exiting the vane 12 at that location so that a sufficient cooling flow is provided to the vane 12 regardless of a flow exiting of the TOBI.

A section of the pressure sidewall 14 is shown removed to reveal pressure side flow channels 30 formed in the pressure sidewall 14 and running chordwise from the leading edge 18 to the trailing edge 20. Each pressure side flow channel 30 receives a pressure side cooling fluid flow 42 and discharges the pressure side cooling fluid flow 42 from an outlet 44 disposed in the trailing edge 20. Suction side flow channels 52 (indicated by dashed lines) may be formed in the suction sidewall 16 running chordwise from the leading edge 18 to the training edge 20 to provide cooling of the suction side of the vane 12. The innovative configuration of the pressure side flow channels 30 and the suction side flow channels 52 are described below with regard to FIGS. 3, 4, and 5.

Figure 1:
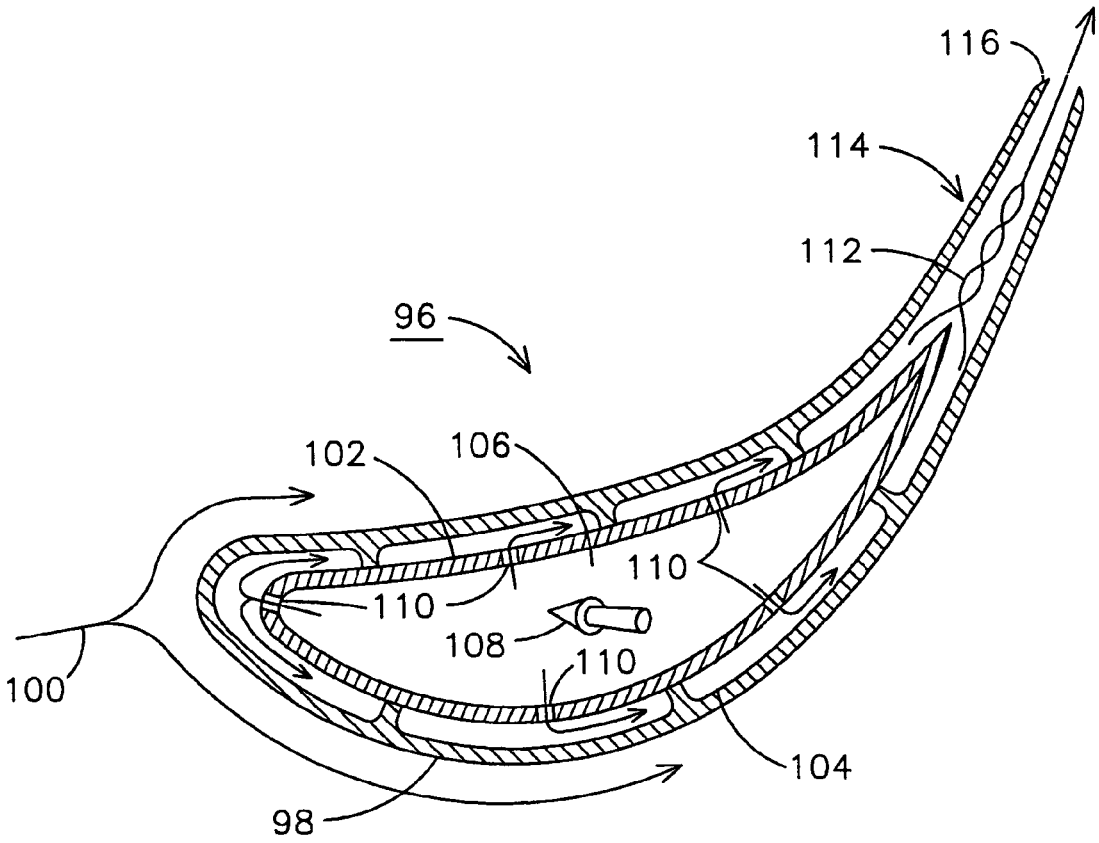
FIG. 1 PRIOR ART
FIG. 1 is a cross section view of a cooled gas turbine vane as known in the art.
Figure 3:
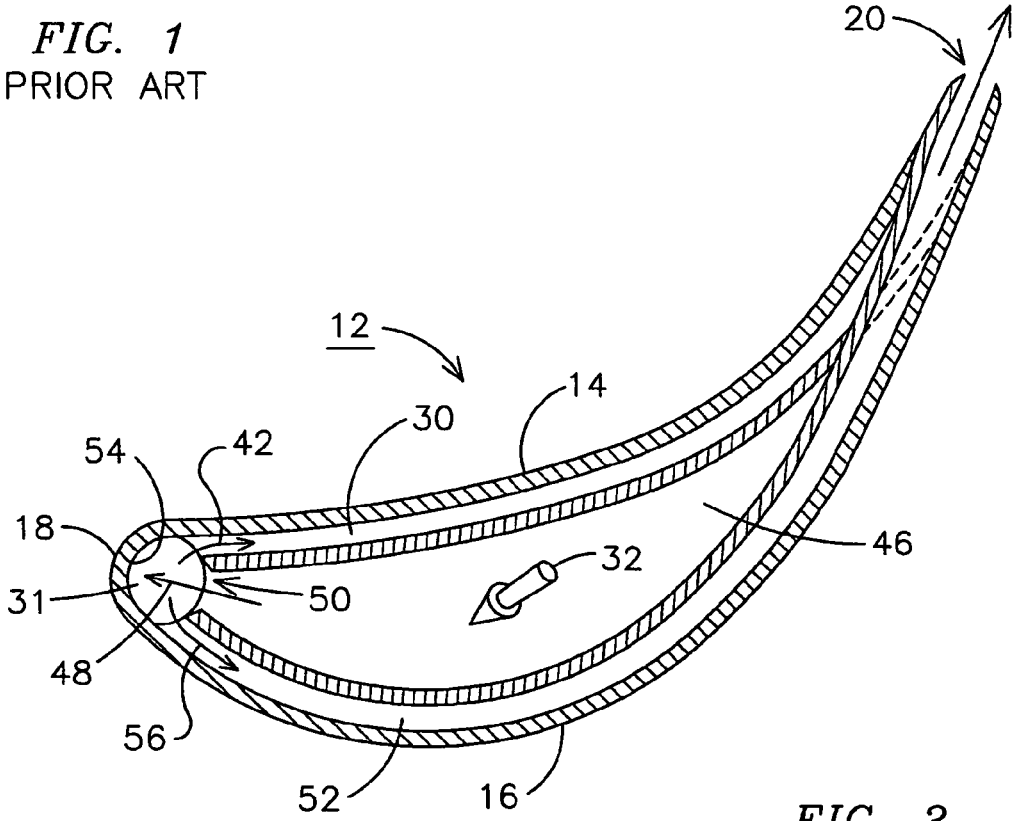
FIG. 3 is a cross sectional view of the gas turbine vane of FIG. 2 taken along line 3—3.
Figure 4:
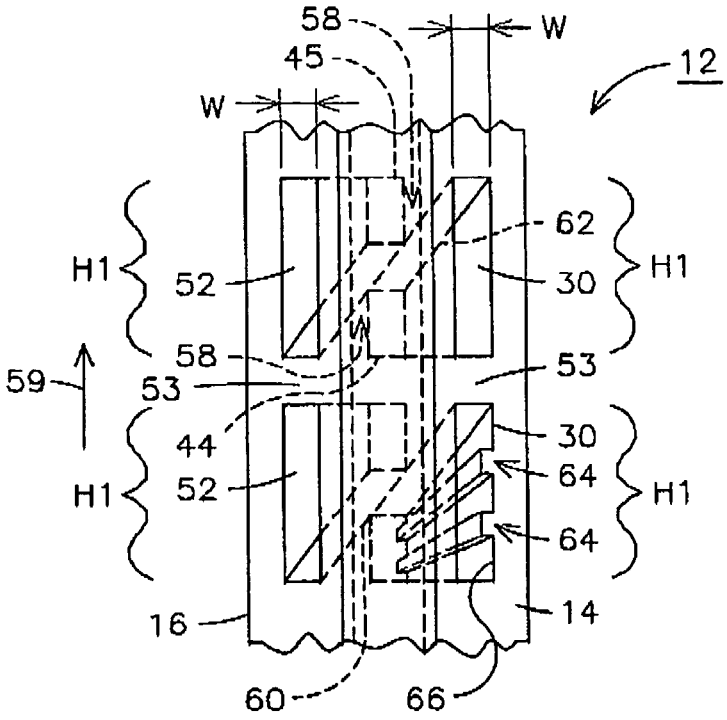
FIG. 4 is a partial cross sectional view of the vane of FIG. 2 taken along line 4—4.
Figure 5:
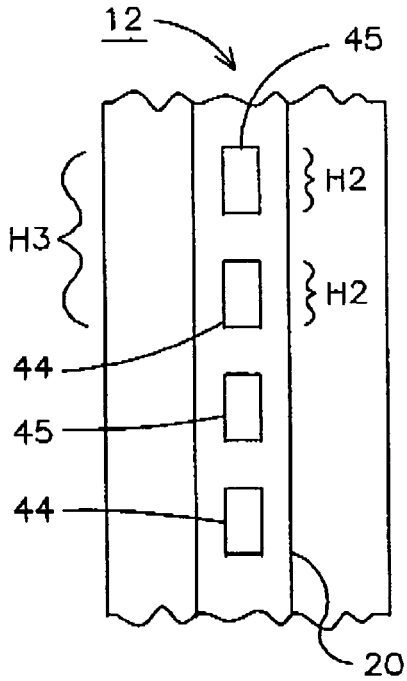
FIG. 5 is partial view of the trailing edge of the vane of FIG. 2 taken along line 5—5.

FIG. 3 is a cross sectional view of the gas turbine vane of FIG. 2 taken along line 3—3, FIG. 4 is a partial cross sectional view of the vane of FIG. 2 taken along line 4—4, and FIG. 5 is partial view of the trailing edge of the vane of FIG. 2 taken along line 5—5. As shown in FIG. 2, the cooling fluid flow 32 injected into the vane 12 (directed into the page) flows through the vane 12 in a radially extending cavity 46. The cavity 46 is configured to receive the cooling fluid flow 32 through the O.D. shroud 24 and discharge at least a portion of the cooling fluid flow 32 through the I.D. shroud 24. A vane cooling portion 48 of the cooling fluid flow 32 may be fed into a plenum 31, for example, extending along the leading edge 18 of the vane 12, and then into respective pressure side flow channels 30 and suction side flow channels 52 in fluid communication with the plenum 31. For example, the vane cooling portion 48 may be directed through impingement holes 50 spaced along the leading edge 18 and impinged upon a backside 54 of the leading edge 18 of the vane 12. After impingement on the backside 54 of the leading edge 18, the vane cooling portion 48 divides into the pressure side cooling fluid flow 42 and a suction side cooling fluid flow 56 and is directed into respective cooling channels 30, 52. The flows 42, 56, flow through the respective flow channels 30, 52 providing convective cooling of the sidewalls 14, 16 of the vane 12 until being separately discharged at the trailing edge 20. Advantageously, the flows 42, 56, flowing through the respective flow channels 30, 52 may provide a degree of insulation between the hot combustion gas flowing around the vane and the cooling fluid flow 32 not achievable in other cooled vane designs. In an aspect of the invention, the flow channels 30, 52 are not in fluid communication with each other. By providing independent flow channels 30, 52, if a flow channel should become damaged (such as by a foreign object piercing the flow channel, allowing leakage of a cooling fluid from the flow channel) the damage may not affect other flow channels, allowing the airfoil to continue being cooled.

As shown in FIG. 4, the flow channels 30, 52 formed in the pressure sidewall 14 and suction sidewall 16 may be rectangular in cross section and have a height H1 measured in a radial direction 59. In an aspect of the invention, a plurality of pressure side flow channels 30, radially spaced apart and separated by chordwise oriented ribs 53, may be formed in the pressure sidewall 14 as shown in FIG. 4. Similarly, a plurality of suction side flow channels 52, radially spaced apart and separated by chordwise oriented ribs 53, may be formed in the suction sidewall 16. Each flow channel 30, 52 may be separately configured and sized corresponding to an external heat load on respective pressure and suction sides of the vane 12. The height H1 of each flow channel 30, 52 may be selected to achieve a desired degree of cooling for the corresponding portion of the sidewall 14,16 adjacent to the flow channel 30, 52. For example, a flow channel height may be increased to provide more cooling to a desired area compared to a smaller flow channel height. A flow channel 30, 52 may also include one or more chordwise fins 64 formed in a wall 66 of the channel to provide additional convective cooling surfaces within the flow channel 30, 52. Geometries of the flow channels 30, 52 on the pressure and suction sides may be different to achieve, for example, a desired cooling effect and/or structural rigidity. Advantageously, by including flow channels (such as rectangular flow channels 30, 52 separated by chordwise oriented ribs 53) within the sidewalls 14, 16 of the vane, an outer wall thickness may be made thinner than a conventional vane outer wall. Accordingly, a heat conduction distance may be reduced to provide more efficient cooling compared to convention thicker walled vanes while still providing sufficient structural rigidity to withstand forces on the vane while the turbine is operating.

The inventor has innovatively realized that by providing independent pressure side flow channels 30 and suction side flow channels 52 that do not mix before exiting the trailing edge 20 (instead of mixing as in conventional thin wall vane cooling designs) improved localized cooling control of the vane 12 may be achieved, such as by keeping the outlets of the flow channels 30, 52 separate. However, a combined height of the pressure side flow channels 30 and suction side flow channels 52 may be greater than an available height along the trailing edge 20 of the vane thereby preventing positioning of all the outlets of the flow channels 30, 52 therein. Accordingly, the inventor has developed an innovative technique to allow the outlets of all the flow channels to exit at the trailing edge 20. By providing a transition region 58 in some or all of the flow channels 30, 52, the respective outlets of all of the flow channels may be disposed independently in the trailing edge 20, for example, as shown in FIGS. 4 and 5. A pressure side flow channel 30 and a suction side flow channel 52 may be arranged in parallel alignment to form a chordwise oriented pair, each flow channel 30, 52 having a transition region 58 narrowing from a height of the channel H1 to an outlet height H2 less then the height of the channel H1, so that the respective channel outlets may be positioned in the trailing edge 20. For example, a suction side outlet 45 and the pressure side outlet 44 corresponding to the pair of flow channels 30, 52 may be positioned along the trailing edge 20 within a total height H3 of about the same height or less than height H1.

In a further aspect of the invention, the transition regions 58 of a paired pressure side flow channel 30 and suction side flow channel 52 may be sized and configured so the channels 30, 52 do not intersect each other in a trailing edge region 19 as the suction sidewall 16 and pressure sidewall 14 join at the trailing edge 20. For example, as indicated by the dashed lines shown in FIG. 4, the suction side flow channel 52 may have a transition region 58 tapering on one side of the flow channel 52 in a chordwise direction from height H1 to an outlet height H2, while a corresponding pressure side flow channel 30 may have a complementary transition region 58 tapering on one side of the flow channel 30 in a chordwise direction from height H1 to outlet height H2, so that the respective outlets 44 may be positioned along the trailing edge 20 of the vane 12 within height H3. The transition region 58 may include a linear taper 60 from flow channel height H1 to outlet height H2. In another aspect, the transition region 58 may include a curved taper 62, such as a curve corresponding to a conic section, from flow channel height H1 to outlet height H2. Advantageously, a cooling fluid flow flowing in the channels 30,52 may be accelerated to a higher velocity in the transition region 58 according to known fluid dynamics laws, thereby generating a comparatively higher heat transfer coefficient in the transition region 58 for cooling a trailing edge region 19 of the vane 12. In addition, a width W of each channel 30, 52 may be varied in a chordwise direction to regulate a flow velocity through the channel to achieve a desired cooling effect.

Figure 6:
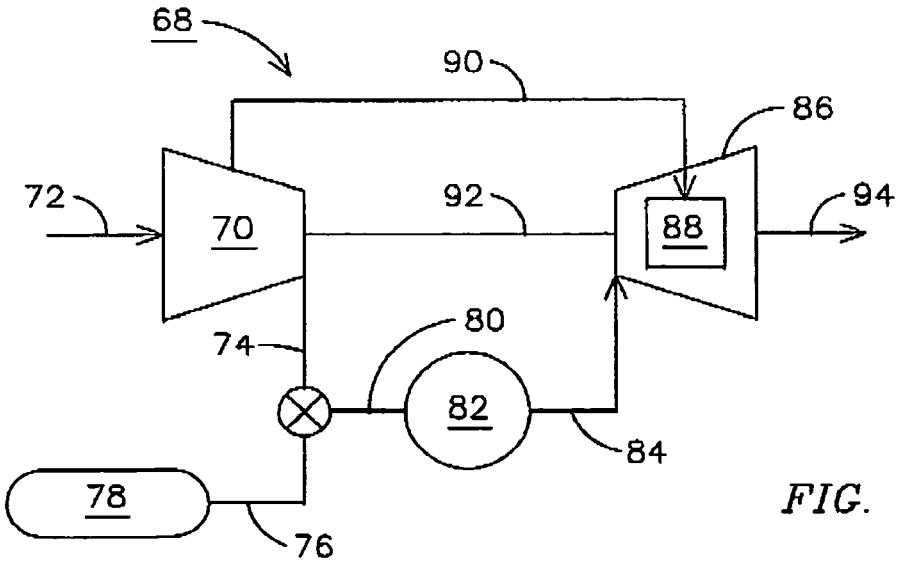
FIG. 6 is a functional diagram of a combustion turbine engine having a turbine including a cooled vane of the current invention.

FIG. 6 illustrates a gas turbine engine 68 including an exemplary cooled airfoil 88 as described herein. The gas turbine engine 68 may include a compressor 70 for receiving a flow of filtered ambient air 72 and for producing a flow of compressed air 74 The compressed air 74 is mixed with a flow of a combustible fuel 76, such as natural gas or fuel oil, provided, for example, by a fuel source 78, to create a fuel-oxidizer mixture flow 80 prior to introduction into a combustor 82. The fuel-oxidizer mixture flow 80 is combusted in the combustor 82 to create a hot combustion gas 84.

A turbine 86, including the airfoil 88, receives the hot combustion gas 84, where it is expanded to extract mechanical shaft power. In an aspect of the invention, the airfoil 88 is cooled by a flow of cooling air 90 bled from the compressor 70 using the technique of providing separate suction side and pressure side flow channels as previously described. In one embodiment, a common shaft 92 interconnects the turbine 86 with the compressor 86, as well as an electrical generator (not shown) to provide mechanical power for compressing the ambient air 66 and for producing electrical power, respectively. The expanded combustion gas 94 may be exhausted directly to the atmosphere or it may be routed through additional heat recovery systems (not shown).

While the preferred embodiments of the present invention have been shown and described herein, it will be obvious that such embodiments are provided by way of example only. Numerous variations, changes and substitutions will occur to those of skill in the art without departing from the invention herein. For example, the cooling technique described above may be used for other cooled turbine airfoils, such as a turbine blade. Accordingly, it is intended that the invention be limited only by the spirit and scope of the appended claims.

What is claimed is:

1. A gas turbine airfoil comprising:

a pressure sidewall and a suction sidewall joined along respective leading and trailing edges and extending radially outward from an inner diameter to a outer diameter;

a plurality of suction side flow channels extending chordwise within the suction sidewall and having respective heights selected to achieve a desired degree of cooling for the suction sidewall;

a plurality of pressure side flow channels extending chordwise within the pressure sidewall and having respective heights selected to achieve a desired degree of cooling for the pressure sidewall;

wherein a combined height of the suction side flow channels and the pressure side flow channels is greater than an available height along the trailing edge; and a transition region in each flow channel wherein the height of the channel is reduced to an outlet height so that respective outlets of the flow channels can each be independently disposed in the trailing edge.

2. The airfoil of claim 1, the transition region comprising a linear taper from the height of the channel to the outlet height.

3. The airfoil of claim 1, the transition region comprising a curved taper from the height of the channel to the outlet height.

4. The airfoil of claim 1, further comprising a convective cooling fin formed in a wall of at least one of the flow channels.

5. The airfoil of claim 1, wherein the pressure side flow channels are aligned in parallel with corresponding suction flow side channels and the plurality of suction side flow channel outlets are interposed between respective pressure side flow channel outlets.

6. The airfoil of claim 1, further comprising a leading edge plenum receiving a cooling fluid flow and discharging a suction side cooling fluid flow into respective suction side flow channels and discharging a pressure side cooling fluid flow into respective pressure side flow channels.

7. A gas turbine engine comprising the airfoil of claim 1.

8. A gas turbine airfoil comprising:

a pressure sidewall and a suction sidewall joined along respective leading and trailing edges and extending radially outward from an inner diameter to a outer diameter;

a leading edge plenum receiving a cooling fluid flow and discharging a suction side cooling fluid flow and a pressure side cooling fluid flow;

a suction side flow channel integrally formed within the suction sidewall and extending chordwise within the suction sidewall from the leading edge plenum to the trailing edge and receiving the suction side cooling fluid flow from the leading edge plenum, conducting the suction side cooling fluid flow along an entire length of the suction side flow channel, and discharging the suction side cooling fluid flow from a first outlet disposed along the trailing edge, the suction side flow channel having a height along an upstream portion that is greater than a height of the first outlet;

a pressure side flow channel integrally formed within the pressure sidewall and extending chordwise within the pressure sidewall from the leading edge plenum to the trailing edge and receiving the pressure side cooling fluid flow from the leading edge plenum, conducting the pressure side cooling fluid flow along an entire length of the pressure side flow channel, and discharging the pressure side cooling fluid flow from a second outlet disposed along the trailing edge, the pressure side flow channel having a height along an upstream portion that is greater than a height of the second outlet; and the first outlet and the second outlet disposed adjacent one another along the trailing edge so that the respective cooling flows do not mix before exiting the airfoil.

9. The airfoil of claim 8, further comprising a transition region in each flow channel wherein the height of the channel is reduced to the height of the outlet so that the respective outlets of the flow channels can each be independently disposed in the trailing edge.

10. The airfoil of claim 9, the transition region comprising a linear taper from the height of the channel to the height of the outlet.

11. The airfoil of claim 9, the transition region comprising a curved taper from the height of the channel to the height of the outlet.

12. The airfoil of claim 8, further comprising a convective cooling fin formed in a wall of at least one of the flow channels.

13. A gas turbine engine comprising the airfoil of claim 8.

14. A gas turbine airfoil comprising:

a pressure sidewall and a suction sidewall joined along respective leading and trailing edges and extending radially outward from an inner diameter to an outer diameter, the pressure and suction sidewalls defining a cooling fluid flow channel conducting a cooling fluid flow from an inlet in the outer diameter to an exit in the inner diameter;

a leading edge plenum receiving a plenum portion of the cooling fluid flow and discharging a suction side cooling fluid flow and a pressure side cooling fluid flow;

a suction side flow channel integrally formed within the suction sidewall and extending chordwise within the suction sidewall from the leading edge plenum to the trailing edge and receiving the suction side cooling fluid flow from the leading edge plenum, conducting the suction side cooling fluid flow along an entire length of the suction side flow channel, and discharging the suction side cooling fluid flow from a first outlet disposed along the trailing edge, the suction side flow channel selected to achieve a desired degree of insulation between a hot combustion gas flowing around the exterior of the airfoil and the cooling fluid flow;

a pressure side flow channel integrally formed within the pressure sidewall and extending chordwise within the pressure sidewall from the leading edge plenum to the trailing edge and receiving a pressure side cooling fluid flow from the leading edge plenum, conducting the pressure side cooling fluid flow along an entire length of the pressure side flow channel, and discharging the pressure side cooling fluid flow from a second outlet disposed along the trailing edge, the pressure side flow channel selected to achieve a desired degree of insulation between the hot combustion gas and the cooling fluid flow; and the first outlet and the second outlet disposed adjacent one another along the trailing edge so that the respective cooling flows do not mix before exiting the airfoil.

15. The gas turbine airfoil of claim 14, the exit comprising a passageway configured to control the cooling fluid flow exiting the airfoil so that a sufficient cooling flow is retained within the airfoil to provide a desired degree of cooling for the airfoil.

16. A gas turbine engine comprising the airfoil of claim 14.

* * * * *